US010062559B2

(12) United States Patent
Zhu et al.

(10) Patent No.: US 10,062,559 B2
(45) Date of Patent: Aug. 28, 2018

(54) LASER DESORPTION ELECTROSPRAY IONIZATION SOURCE

(71) Applicant: ZHEJIANG HAOCHUANG BIOTECH CO., LTD., Zhejiang (CN)

(72) Inventors: Yixin Zhu, Zhejiang (CN); Tingting Lu, Zhejiang (CN)

(73) Assignee: ZHEJIANG HAOCHUANG BIOTECH CO., LTD., Hangzhou, Zhejiang (CN)

( * ) Notice: Subject to any disclaimer, the term of this patent is extended or adjusted under 35 U.S.C. 154(b) by 0 days.

(21) Appl. No.: 15/331,354

(22) Filed: Oct. 21, 2016

(65) Prior Publication Data

US 2017/0117126 A1 Apr. 27, 2017

(30) Foreign Application Priority Data

Oct. 23, 2015 (CN) ..... 2015 1 07025038

(51) Int. Cl.
*H01J 49/16* (2006.01)
*H01J 49/26* (2006.01)

(52) U.S. Cl.
CPC ..... *H01J 49/164* (2013.01); *H01J 49/165* (2013.01); *H01J 49/26* (2013.01)

(58) Field of Classification Search
CPC ..... H01J 49/16; H01J 49/162; H01J 49/164; H01J 49/165; H01J 49/167; H01J 49/26; H01J 49/28
See application file for complete search history.

(56) References Cited

U.S. PATENT DOCUMENTS 5,376,789 A * 12/1994 Stenhagen ..... G01N 30/7266 250/281
6,444,980 B1 * 9/2002 Kawato ..... H01J 49/164 250/281
7,087,895 B1 * 8/2006 Liu ..... H01J 49/167 250/281
2009/0039282 A1 * 2/2009 Haase ..... H01J 49/164 250/423 R
2011/0049352 A1 * 3/2011 Ding ..... H01J 49/0463 250/282
2011/0121173 A1 * 5/2011 Koenig ..... H01J 49/0409 250/282

(Continued)

OTHER PUBLICATIONS

Ivory X. Peng, Rachel R. Ogorzalek Loo, Jentaie Shiea and Joseph A. Loo; Reactive-Electrospray-Assisted Laser Desorption/Ionization for Characterization of Peptides and Proteins; Anal. Chem., 2008, 80 (18), pp. 6995-7003.

(Continued)

*Primary Examiner* — David E Smith
(74) *Attorney, Agent, or Firm* — BainwoodHuang

(57) ABSTRACT

A laser desorption electrospray ionization source includes a sample platform configured to support a sample material to be analyzed, an ion transfer tube having a first end and a second end, the first end facing in a direction of the sample platform, the second end connected to a mass spectrometer for providing sample molecules for spectral analysis, and a hollow emission needle having a tip that forms an electrospray nozzle, the tip extending to or into the first end of the ion transfer tube, such that the sample molecules pass the tip of the hollow emission needle on their way to the mass spectrometer.

13 Claims, 2 Drawing Sheets

(56) References Cited

U.S. PATENT DOCUMENTS

| | | | | |
|---|---|---|---|---|
| 2012/0286155 | A1* | 11/2012 | Mulligan | H01J 49/0445 250/282 |
| 2013/0009055 | A1* | 1/2013 | Zhu | G01N 30/7266 250/288 |
| 2013/0280819 | A1* | 10/2013 | Cooks | H01J 49/0445 436/173 |
| 2015/0187558 | A1* | 7/2015 | Mills | G01N 33/4833 250/288 |

OTHER PUBLICATIONS

Santosh Karki, Paul M. FlaniganIV, Johnny J. Perez,Jieutonne J. Archer, Robert J. Levis; Increasing Protein Charge State When Using Laser Electrospray Mass Spectrometry; Journal of the American Society for Mass Spectrometry, Mar. 2015.

Yohannes H. Rezenom, Jianan Dong and Kermit K. Murray; Infrared laser-assisted desorption electrospray ionization mass spectrometry; Analyst, 2008, 133, 226-232.

Jia Liu, Bo Qiu,Hai Luo; Fingerprinting of yogurt products by laser desorption spray post-ionization mass spectrometry; Apr. 6, 2010.

Peter Nemes and Akos Vertes; Laser Ablation Electrospray Ionization for Atmospheric Pressure, in Vivo, and Imaging Mass Spectrometry; Anal. Chem., 2007, 79 (21), pp. 8098-8106.

* cited by examiner

LASER DESORPTION ELECTROSPRAY IONIZATION SOURCE

CROSS-REFERENCES TO RELATED APPLICATIONS

This application claims the benefit of Chinese Patent Application No. 2015/107025038, filed Oct. 23, 2015, the contents and teachings of which are incorporated herein by reference in their entirety.

BACKGROUND

1. Field of the Invention

The present invention relates generally to electrospray ionization mass spectrometry, and more specifically to a laser desorption electrospray ionization source that can improve the molecular ionization efficiency of a sample.

2. Description of the Related Art

Laser desorption ionization uses a pulse laser to irradiate sample molecules to vaporize and protonate them in preparation for carrying out mass spectrometry detection. One issue with known laser desorption approaches concerns laser intensity. When laser intensity is low, sample molecules do not easily produce ions. But when laser intensity is high, burning of droplets may result. At present, a conventional approach is to use a combination of laser thermal effects and electrospray ionization to form a laser desorption electrospray ionization source.

FIG. 1 shows an example of this prior scheme. As shown, an analyte placed on the target sample is irradiated to rapid evaporation with a certain frequency of laser pulses 70. Evaporation moves analyte molecules to a location between a Taylor cone tip of a hollow emission needle 10 and an ion transfer tube 13. The analyte molecules exchange charge with charged droplets formed by electrospraying to form ionized sample molecules, which may be drawn into the mass spectrometer 50 for analysis.

SUMMARY

Unfortunately, the existing traditional laser desorption electrospray ionization source as shown in FIG. 1 suffers from the following deficiencies:

1. The impact point of the laser pulses 70 is located between the Taylor cone 11 and the ion transfer tube 13. Often, analyte molecules that are evaporated by laser bombardment cannot reach the Taylor cone 11 due to the negative voltage of the mass spectrometer 50. Away from the Taylor cone 11, under a weak electric field, the analyte molecules may fail to become polarized, such that many neutral molecules remain. Such neutral molecules may enter the mass spectrometer 50, polluting the mass spectrometer 50 and providing a very low yield of ionized molecules that are available for the mass spectrometer 50 to analyze.

2. The sample platform 30 for carrying the analyte molecules may be open to the atmosphere, such that analyte molecules evaporated by laser bombardment cannot always be fully pulled into the mass spectrometer 50, even if successfully ionized. As a result, transmission efficiency from the ESI source and detection sensitivity of the mass spectrometer 50 are both undesirably low.

In contrast with prior approaches, embodiments are directed to a laser desorption electrospray ionization source that includes a sample platform configured to support a sample material to be analyzed, an ion transfer tube having a first end and a second end, the first end facing in a direction of the sample platform, the second end connected to a mass spectrometer for providing sample molecules for spectral analysis, and a hollow emission needle having a tip that forms an electrospray nozzle, the tip extending to or into the first end of the ion transfer tube, such that the sample molecules pass the tip of the hollow emission needle on their way to the mass spectrometer. Other embodiments are directed to a method of using a laser desorption electrospray ionization source to perform spectral analysis. Advantageously, the disclosed embodiments increase the yield of ions for spectral analysis and thus promote more accurate analysis. The disclosed embodiments also increase transport efficiency of ions to the mass spectrometer.

The foregoing summary is presented for illustrative purposes to assist the reader in readily grasping example features presented herein; however, it is not intended to set forth required elements or to limit embodiments hereof in any way.

BRIEF DESCRIPTION OF THE SEVERAL VIEWS OF THE DRAWINGS

A further understanding of the present invention can be obtained by reference to a preferred embodiment set forth in the illustrations of the accompanying drawings, in which like numbers refer to like elements throughout. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention. For a more complete understanding of the present invention, reference is now made to the following drawings in which:

DETAILED DESCRIPTION OF THE INVENTION

Figure 1:
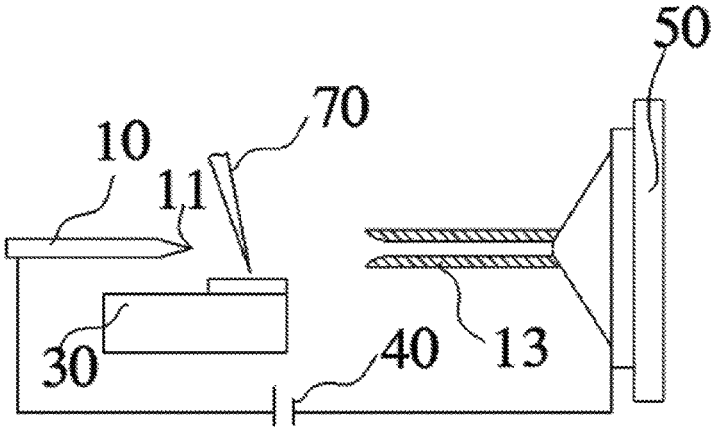
FIG. 1 (Prior Art)
FIG. 1 is the structural schematic diagram of a traditional laser desorption electrospray ionization source.

Embodiments of the invention will now be described. It should be appreciated that such embodiments are provided by way of example to illustrate certain features and principles of the invention but that the invention hereof is not limited to the particular embodiments described.

Overview of Embodiments

Embodiments of the present invention are directed to a high efficiency laser desorption electrospray ionization source with high ionization probability of sample molecules and high detection sensitivity of the mass spectrometer.

In an example, embodiments are realized by the application of a laser desorption ESI source, which includes a hollow emission needle, an ion transfer tube, a sample platform on which a sample target is disposed, and a laser. One end of the hollow emission needle provides a liquid intake and the other end provides an electrospray nozzle. A first end of the ion transfer tube is opposite the nozzle of the hollow emission needle, while a second end is communicated with a vacuum chamber of the mass spectrometer. An ESI source supply apparatus is electrically connected between the mass spectrometer and the hollow emission needle. Laser pulses generated by the laser irradiate an analyte placed on the sample target. In an example, the impact point of laser pulses on the analyte is disposed behind the nozzle of the hollow emission needle. For instance, the impact point of the laser pulses on the sample target is located in front of the ion transfer tube but behind the Taylor cone formed by the hollow emission needle. Analyte molecules, which are evaporated by the laser pulses, flow in the inlet direction of the ion transfer tube, due to the negative voltage of the mass spectrometer, and gather at the Taylor cone field, thus achieving high polarization efficiency of sample molecules. Compared with the traditional laser desorption ESI source, the disclosed embodiments hereof overcome the deficiency that sample molecules cannot be aggregated in the Taylor cone field and thus avoid polarization by the high electric field.

Preferably, a distance d between the impact point of the laser pulses on the analyte placed on the sample target and the horizontal direction of the hollow emission needle is 0~500 mm. At this distance, under the negative voltage of the mass spectrometer, most of the analyte molecules evaporated by laser bombardment can move into the Taylor cone field of the hollow emission needle and become polarized by the high electric field.

Preferably, there is a source working chamber provided outside of the hollow emission needle, the ion transfer tube, and the sample platform. One edge of the source working chamber connects to the mass spectrometer. With this arrangement, the source working chamber can form a seal around the hollow emission needle, the sample platform, and the ion transfer tube, and a negative pressure can be maintained therein, thus better enabling sample molecular ion clusters, which are formed in the field of the Taylor cone, to be drawn into the ion transfer tube and thus into the mass spectrometer.

Further, at least one auxiliary line is arranged between the source working chamber and the hollow emission needle. The auxiliary line may provide a source of protons (H+) in gaseous form, such as in a gas with water or organic acid vapor. The gas with water can be a mixture of water vapor, a mixture of acid gas and water vapor, a mixture of organic acid vapor and water vapor, or a mixture of nitrogen or argon gas or other gas and water vapor, for example. The effect of introducing such gas is to increase the number of hydrogen ions around the Taylor cone, which promotes ionization of molecules, thus increasing the charge probability of the analyte samples.

Preferably, the nozzle of the hollow emission needle extends a distance y of 0~500 mm into a port of the ion transfer tube. As the nozzle of the hollow emission needle is disposed within the ion transfer tube, the Taylor cone forms therein, as well. Once sample molecules become polarized and ionized in the Taylor cone field, they pass directly though the ion transfer tube into the mass spectrometer for analysis, thus achieving high efficiency of ion transmission while also increasing the probability that the sample will be charged.

As a better choice, there is an emission needle-lock ring sheathed on or around the outside of the hollow emission needle, there is a first auxiliary line arranged between the emission needle-lock ring and the emission needle, and there is a second auxiliary line arranged between the emission needle-lock ring and the source working chamber. One auxiliary line can provide the gas as the source of protons and the other auxiliary line can provide room temperature gas or a temperature controllable gas, which promotes stability of the Taylor cone and/or accelerated formation of molecular gas phase charge singly of the polarized sample molecules.

Preferably, a source working chamber is provided with a laser input window through which laser pulses may be passed (e.g., from a laser disposed outside the source working chamber.

As a better choice, the laser input window is arranged on the source working chamber of the ESI source at a location corresponding to the sample platform, and the laser pulses pass through the laser input window above or below into the source working chamber.

Preferably, the sample target is made of laser-transparent material. For example, in designs in which laser pulses enter the source working chamber from below the laser input window, the sample target must be made of laser-transparent material, in order to allow laser bombardment of sample molecules placed in the target sample.

Preferably, the sample target is electrically connected with a sample target power supply, and the voltage of the sample target power supply is 1~50 KV. This setting of the sample target power supply can form an electric field between the sample platform and the ion transfer tube, so that the charged particles are encouraged to move to the ion transfer tube.

Compared with existing technology, the laser desorption ESI source of the present invention has the following advantages and effects:

1. In the laser desorption ESI source, the impact point of the laser pulses is located behind (to the left in FIG. 2) the Taylor cone and the ion transfer tube. Due to the negative voltage of the mass spectrometer, analyte molecules evaporated by the laser bombardment flow to the entrance of the ion transfer tube. Meanwhile, neutral analyte molecules gather to the Taylor cone, where the high electric field around the Taylor cone effects polarization of analyte molecules. Under the Taylor cone field, water molecules around the Taylor cone become ionized to form protons, i.e., hydrogen (H+). The analyte molecules after polarization absorb the positively charged hydrogen (H+) near the Taylor cone and form ion clusters, which greatly improve the charged probability of the analyte molecules.

2. The sample platform for carrying the analyte molecules, the hollow emission needle, and the transfer tube of the present invention, are all disposed within the source working chamber, which can assume a negative pressure environment by virtue of a connection to the mass spectrometer. Under this negative pressure, the analyte molecules evaporated by laser bombardment can be inhaled into the mass spectrometer, so as to improve the charge probability and also to improve the transmission efficiency of the sample ions and the sensitivity of the mass spectrometer detection and analysis.

DESCRIPTION OF PARTICULAR EXAMPLE EMBODIMENTS

Example 1

Figure 2:
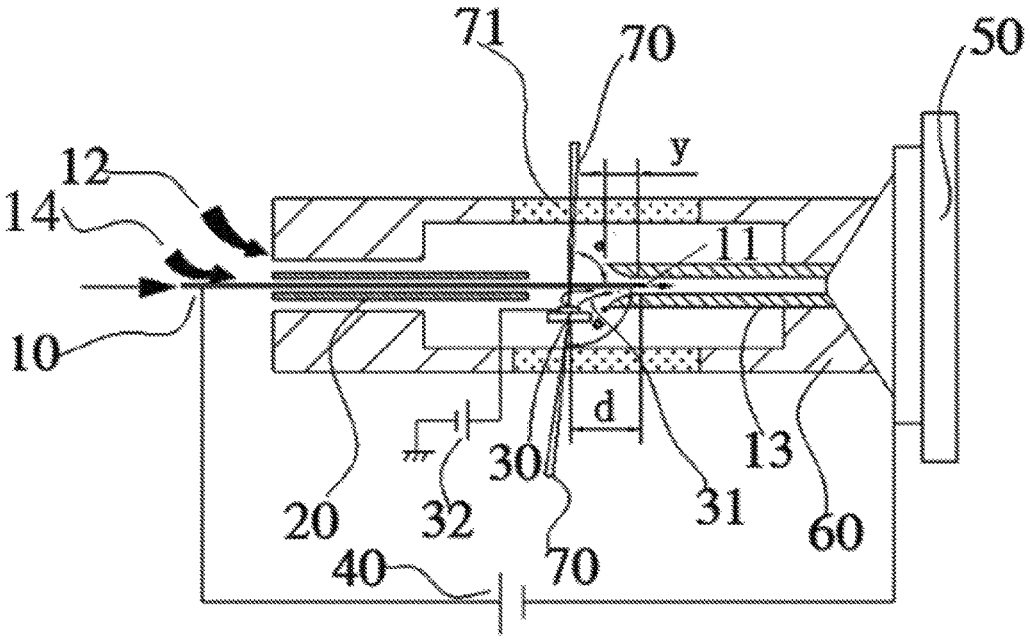
FIG. 2 is the structural schematic diagram of a laser desorption electrospray ionization source in accordance with some embodiments of the present invention.

FIG. 2 shows an example laser desorption electrospray ionization source. The ionization source includes a hollow emission needle 10, an ion transfer tube 13, and a sample platform 30 for receiving samples on a sample target. A laser is used for producing laser pulses 70 directed to the sample target. One end of the hollow emission needle 10 provides a liquid intake and the other end has an electrospray nozzle. A first end of the ion transfer tube 13 is opposite the nozzle of the hollow emission needle 10 and provides an entrance, while a second end is in communication with a vacuum chamber of a mass spectrometer 50. An ESI source supply apparatus 40 is electrically connected between the mass spectrometer 50 and the hollow emission needle 10. The sample platform 30 is located at the entrance of the ion transfer tube 13, such that the impact point of laser pulses 70 on the sample target is located behind (to the left of in FIG. 2) the nozzle of the hollow emission needle 10. A horizontal distance d between the impact point of the laser pulses 70 on the analyte placed on the sample target and the hollow emission needle 10 is 2 mm or 10 mm or 20 mm, for example.

In an example, the hollow emission needle 10 is configured to convey a conductive liquid toward the electrospray nozzle. The source supply apparatus 40 is configured to apply a voltage of 100V-50 KV between the mass spectrometer 50 and the hollow emission needle 10. The Taylor cone 11 is formed at the electrospray nozzle of the hollow emission needle 10.

The laser pulses 70 bombard the analyte on the sample target, causing neutral sample molecules 31 to evaporate. The evaporated neutral sample molecules 31 flow toward the electrospray nozzle of the hollow emission needle 10, under the influence of the negative voltage of the mass spectrometer 50, and gather at the Taylor cone 11, where the neutral sample molecules become polarized by the strong electric field. Water molecules around the Taylor cone (and/or other molecules that provide protons, e.g., hydrogen) become ionized and form protons hydrogen (H+). The analyte molecules after polarization absorb the positively charged hydrogen (H+) near the Taylor cone and form ion clusters. Compared with the existing laser electrospray ionization source, this example embodiment greatly improves the charge probability of the analyte samples.

Example 2

Figure 3:
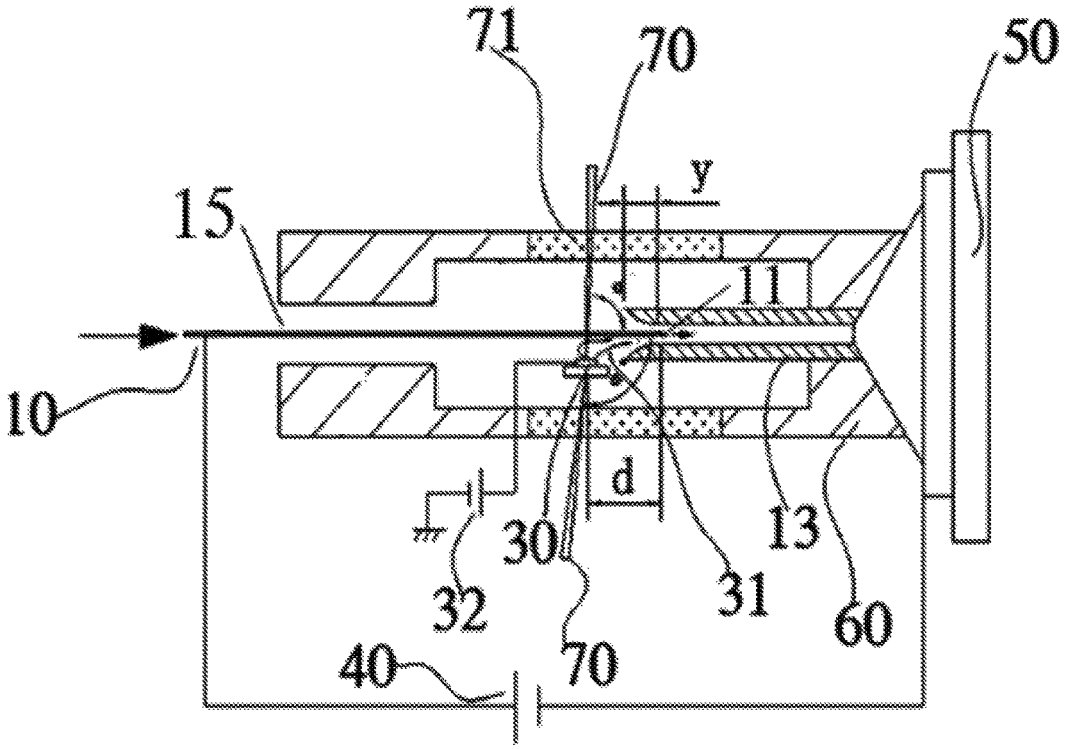
FIG. 3 is the structural schematic diagram of a laser desorption electrospray ionization source in accordance with other embodiments of the present invention.

FIG. 3 shows another example embodiment of a laser desorption electrospray ionization source. The ionization source of FIG. 3 includes a hollow emission needle 10, an ion transfer tube 13, and a sample platform 30 for receiving samples on a sample target. A laser is used for producing laser pulses 70 directed to the sample target. A source working chamber 60 is fitted outside the hollow emission needle 10, the ion transfer tube 13, and the sample platform 30. One end of the source working chamber 60 connects to the mass spectrometer 50. One end of the hollow emission needle 10 provides a liquid intake and the other end has an electrospray nozzle. A first end of the ion transfer tube 13 is opposite the nozzle of the hollow emission needle 10 and provides an entrance, while a second end is in communication with a vacuum chamber of a mass spectrometer 50. An ESI source supply apparatus 40 is electrically connected between the mass spectrometer 50 and the hollow emission needle 10. The sample platform 30 is located at the entrance of the ion transfer tube 13, such that the impact point of laser pulses 70 on the sample target is located behind (to the left of) the nozzle of the hollow emission needle 10. A horizontal distance d between the impact point of the laser pulses 70 on the analyte placed on the sample target and the hollow emission needle 10 is 2-10 mm or 10-20 mm, for example. An auxiliary line 15 is arranged between the hollow emission needle 10 and the source working chamber 60. The auxiliary line 15 is used to supply gas with water or organic acid vapor or other gas that can provide protons.

The gas introduced via the auxiliary line 15 may include can be a mixture of water vapor, a mixture of acid gas and water vapor, a mixture of organic acid vapor and water vapor, or a mixture of nitrogen or argon gas or other gas and water vapor, for example. The effect of supplying gas through the auxiliary line 15 is to provide more hydrogen ions around the Taylor cone, which can provide the hydrogen ions needed for sample the molecules to become ionized, thus increasing the charge probability of the analyte samples.

In the laser desorption electrospray ionization source of this example, the sample platform 30 for carrying the analyte molecules and the hollow emission needle 10 are both located within the source working chamber 60, which can assume a negative pressure environment by virtue of a connection to the mass spectrometer. Under this negative pressure, the analyte molecules evaporated by laser bombardment can be inhaled into the mass spectrometer, so as to improve the charge probability. Also, in this example, the polarization and charging of the analyte may take place in the same manner to that described in connection with Example 1.

Example 3

As shown in the laser desorption electrospray ionization source FIG. 2, the ionization source includes a hollow emission needle 10, an ion transfer tube 13, and a sample platform 30 for receiving samples on a sample target. A laser is used for producing laser pulses 70 directed to the sample target. A source working chamber 60 is fitted outside the hollow emission needle 10, the ion transfer tube 13, and the sample platform 30. One end of the source working chamber 60 connects to the mass spectrometer 50. One end of the hollow emission needle 10 provides a liquid intake and the other end has an electrospray nozzle. A first end of the ion transfer tube 13 is opposite the nozzle of the hollow emission needle 10 and provides an entrance, while a second end is in communication with a vacuum chamber of a mass spectrometer 50. An ESI source supply apparatus 40 is electrically connected between the mass spectrometer 50 and the hollow emission needle 10. The sample platform 30 is located at the entrance of the ion transfer tube 13, such that the impact point of laser pulses 70 on the sample target is located behind (to the left) the nozzle of the hollow emission needle 10. A horizontal distance d between the impact point of the laser pulses 70 on the analyte placed on the sample target and the hollow emission needle 10 is 2-10 mm, for example. There is an emission needle-lock ring 20 sheathed to the outside of the hollow emission needle 10, and a first auxiliary line 14 is arranged between the emission needle-lock ring 20 and the emission needle 10. There is a second auxiliary line 12 disposed between the emission needle-lock ring 20 and the source working chamber 60. One of these auxiliary lines can introduce gas with water or organic acid steam or other gases that can provide protons. The other auxiliary line can introduce room temperature gas or temperature controllable gas. Introduction of these gases helps to ensure stability of the Taylor cone 11 and/or to accelerate gasification of charged liquid ionization.

Example 4

As shown in the laser desorption electrospray ionization sources of FIGS. 2 and 3, the source working chamber 60 has a laser input window 71, which is available for passing laser pulses. The laser input window 71 is arranged on the source working chamber 60 at a location corresponding to that of the sample platform 30. Laser pulses 70 pass through the laser input window 71 from above or below into the source working chamber 60. When arranged such that laser pulses 70 enter the source working chamber 60 from below the laser input window 71, the sample target is made of laser-transparent materials.

Example 5

As shown in the laser desorption electrospray ionization sources of FIGS. 2 and 3, the nozzle of the hollow emission needle 10 extends into the ion transfer tube 13. The distance y is 0-5 mm or 5-10 mm from the electrospray nozzle of the hollow emission needle 10 to the port of ion transfer tube 13. Thus, the hollow emission needle 10 inserts into the ion transfer tube 13, such that the Taylor cone is formed within the ion transfer tube 13. Neutral sample molecules 31 evaporate and gather around the Taylor cone 11, where they become polarized and ionized. Thereafter, the polarized, ionized molecules pass directly into the mass spectrometer, with high ion transmission efficiency, and are analyzed with high probability of the charge of the sample.

Example 6

As shown in the laser desorption electrospray ionization sources of FIGS. 2 and 3, the sample target connects to a sample target power supply 32. The voltage of the sample target power supply 32 is 10~50 KV, for example. The voltage of the sample target power supply 32 forms an electric field between the sample platform 30 and the ion transfer tube 13, causing charged particles to move faster to the ion transfer tube 13.

Having described certain embodiments, numerous alternative embodiments or variations can be made. Further, although features are shown and described with reference to particular embodiments hereof, such features may be included and hereby are included in any of the disclosed embodiments and their variants. Thus, it is understood that features disclosed in connection with any embodiment are included as variants of any other embodiment.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Further, although ordinal expressions, such as "first," "second," "third," and so on, may be used as adjectives herein, such ordinal expressions are used for identification purposes and, unless specifically indicated, are not intended to imply any ordering or sequence. Thus, for example, a second event may take place before or after a first event, or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Although certain embodiments are disclosed herein, it is understood that these are provided by way of example only and that the invention is not limited to these particular embodiments.

Those skilled in the art will therefore understand that various changes in form and detail may be made to the embodiments disclosed herein without departing from the scope of the invention.

Table of Reference Numerals:

| Ref. Number | Description |
|---|---|
| 10 | Hollow emission needle |
| 11 | Taylor cone |
| 12 | Secondary auxiliary line |
| 13 | Ion transfer tube |
| 14 | First auxiliary line |
| 15 | Auxiliary line |
| 20 | Emission needle-lock ring |
| 30 | Sample platform |
| 31 | Neutral sample molecules |
| 32 | Sample target power supply |
| 40 | ESI source supply apparatus |
| 50 | Mass spectrometer |
| 60 | Source working chamber |
| 70 | Laser pulses |
| 71 | Laser input window |

What is claimed is:

1. A laser desorption electrospray ionization source, comprising:

a sample platform configured to support a sample material to be analyzed;

an ion transfer tube having a first end and a second end, the first end facing in a direction of the sample platform, the second end connected to a mass spectrometer for providing sample molecules for spectral analysis; and a hollow emission needle having a tip that forms an electrospray nozzle, the tip extending to or into the first end of the ion transfer tube, such that the sample molecules pass by but not through the tip of the hollow emission needle on their way to the mass spectrometer.

2. The laser desorption electrospray ionization source of claim 1, further comprising a source supply apparatus electrically connected to the hollow emission needle and to the mass spectrometer, the source supply apparatus constructed and arranged to establish a voltage between the hollow emission needle and the mass spectrometer.

3. The laser desorption electrospray ionization source of claim 2, further comprising a source working chamber, the source working chamber surrounding the sample platform, the ion transfer tube, and the tip of the hollow emission needle, and supporting a negative pressure environment therein.

4. The laser desorption electrospray ionization source of claim 3, wherein the source working chamber has a laser input window composed of a laser-transparent material, the laser input window configured to admit laser pulses directed at the sample material from an external laser source.

5. The laser desorption electrospray ionization source of claim 4, wherein the laser input window is disposed below the sample platform, and wherein the sample platform is composed of a laser-transparent material.

6. The laser desorption electrospray ionization source of claim 4, further comprising a sample target power supply connected between the sample platform and the ion transfer tube for establishing a voltage therebetween.

7. The laser desorption electrospray ionization source of claim 4, further comprising an auxiliary line that extends parallel to the hollow emission needle, the auxiliary line configured to introduce gas into the source working chamber.

8. The laser desorption electrospray ionization source of claim 7, further comprising an emission needle-lock ring disposed around the hollow emission needle, wherein the auxiliary line is provided in a space between the hollow emission needle and the emission needle-lock ring.

9. The laser desorption electrospray ionization source of claim 8, further comprising a second auxiliary line disposed in a space between the emission needle-lock ring and the source working chamber.

10. A method of performing laser desorption electrospray ionization, the method performed using a source that includes:

a sample platform configured to support a sample material to be analyzed;

an ion transfer tube having a first end and a second end, the first end facing in a direction of the sample platform, the second end connected to a mass spectrometer for providing sample molecules for analysis; and a hollow emission needle having a tip that forms an electrospray nozzle, the tip extending into the first end of the ion transfer tube, the method comprising:

applying a voltage between the hollow emission needle and the mass spectrometer to form a Taylor cone near the tip of the hollow emission needle;

bombarding the sample material with laser pulses to produce evaporated molecules;

drawing the evaporated molecules into the first end of the ion transfer tube and through the Taylor cone, to ionize the evaporated molecules, without passing the evaporated molecules through the hollow emission needle; and performing a spectral analysis on the ionized evaporated molecules using the mass spectrometer.

11. The method of claim 10, further comprising applying a voltage between the sample platform and the ion transport tube.

12. The method of claim 11, further comprising:

enclosing the sample platform, the ion transfer tube, and the tip of the hollow emission needle within a source working chamber; and producing a negative pressure within the source working chamber.

13. The method of claim 12, further comprising introducing gas into the source working chamber through a set of auxiliary lines.

* * * * *